US008116911B2

(12) United States Patent
Bailey et al.

(10) Patent No.: US 8,116,911 B2
(45) Date of Patent: Feb. 14, 2012

(54) SYSTEM AND METHOD FOR SUMP HEATER CONTROL IN AN HVAC SYSTEM

(75) Inventors: John J. Bailey, Tyler, TX (US); Jose L. Balderrama, Tyler, TX (US); Jonathan D Douglas, Bullard, TX (US); John R. Edens, Kilgore, TX (US); Alan D. Marble, Whitehouse, TX (US); Gary L. Sapp, Tyler, TX (US); Kristen L. Schaefer, Tyler, TX (US); Brett R. Schneider, Tyler, TX (US); Steven A. Tice, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 552 days.

(21) Appl. No.: 12/272,504

(22) Filed: Nov. 17, 2008

(65) Prior Publication Data

US 2010/0125368 A1 May 20, 2010

(51) Int. Cl.
*G06F 19/00* (2006.01)

(52) U.S. Cl. ..... 700/276; 417/12

(58) Field of Classification Search ..... 417/12; 700/276

See application file for complete search history.

(56) References Cited

U.S. PATENT DOCUMENTS

| | | | | |
|---|---|---|---|---|
| 4,326,387 | A | | 4/1982 | Friedman |
| 4,467,613 | A | | 8/1984 | Behr et al. |
| 4,749,881 | A | | 6/1988 | Ulrich |
| 4,974,420 | A | | 12/1990 | Kramer |
| 5,138,844 | A | | 8/1992 | Clanin et al. |
| 5,230,222 | A | * | 7/1993 | Erbs ..... 62/192 |
| 5,377,497 | A | | 1/1995 | Powell |
| 5,410,230 | A | * | 4/1995 | Bessler et al. ..... 318/471 |
| 5,506,487 | A | * | 4/1996 | Young et al. ..... 318/811 |
| 5,507,154 | A | | 4/1996 | Grant |
| 5,605,053 | A | | 2/1997 | Otori |
| 5,970,727 | A | | 10/1999 | Hiraoka et al. |
| 6,021,644 | A | | 2/2000 | Ares et al. |
| 6,181,538 | B1 | | 1/2001 | Yoo |
| 6,216,479 | B1 | | 4/2001 | Elwood |
| 6,396,033 | B1 | * | 5/2002 | Renwick et al. ..... 219/538 |
| 6,434,957 | B1 | | 8/2002 | Nishizuka et al. |
| 6,658,373 | B2 | | 12/2003 | Rossi et al. |
| 6,842,650 | B2 | | 1/2005 | Bennett |
| 7,024,254 | B2 | | 4/2006 | Salsbury et al. |
| 7,079,967 | B2 | | 7/2006 | Rossi et al. |
| 7,085,626 | B2 | * | 8/2006 | Harrod et al. ..... 700/276 |
| 7,222,494 | B2 | | 5/2007 | Peterson et al. |
| 2002/0026800 | A1 | * | 3/2002 | Kasai et al. ..... 62/85 |
| 2005/0234597 | A1 | * | 10/2005 | Harrod et al. ..... 700/276 |
| 2010/0011788 | A1 | * | 1/2010 | Lifson et al. ..... 62/115 |

* cited by examiner

*Primary Examiner* — Michael D Masinick
(74) *Attorney, Agent, or Firm* — Conley Rose, P.C.; J. Robert Brown, Jr.

(57) ABSTRACT

A system and a method are provided for powering up a heating, ventilation, and air conditioning (HVAC) system and operating a sump heater for a compressor for a first predetermined period of time in response to the HVAC system being powered up. A heating, ventilation, and air conditioning system and a method for controlling the system are provided. The HVAC system includes a compressor, a sump heater associated with the compressor, and a controller configured to control the compressor and the sump heater so that the sump heater is not operated while the compressor is operated.

23 Claims, 4 Drawing Sheets

SYSTEM AND METHOD FOR SUMP HEATER CONTROL IN AN HVAC SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Heating, ventilation, and air conditioning systems (HVAC systems) are used in residential and/or commercial areas for heating and/or cooling to create comfortable temperatures inside those areas. These temperature controlled areas may be referred to as comfort zones. Comfort zones may comprise different zone conditions (i.e., temperature, humidity, etc.) and the locations in which the HVAC systems are installed or otherwise associated with for the purpose of performing heat exchange (sometimes referred to as an ambient zone) may also have different conditions. Both the zone conditions and the conditions of the location affect operation of the HVAC systems and, where the conditions are different, may result in otherwise substantially similar HVAC systems operating at different efficiencies. Some HVAC systems are heat pump systems. Heat pump systems are generally capable of cooling a comfort zone by operating in a cooling mode for transferring heat from a comfort zone to an ambient zone using a refrigeration cycle (i.e., Rankine cycle). When the temperature of an ambient zone in which a portion of an HVAC system is installed or otherwise associated with is colder than the temperature of a comfort zone with which the HVAC system is associated, the heat pump systems are also generally capable of reversing the direction of refrigerant flow (i.e., a reverse-Rankine cycle) through the components of the HVAC system so that heat is transferred from the ambient zone to the comfort zone (a heating mode), thereby heating the comfort zone.

One example of rating the cooling energy efficiency of an HVAC system is the use of the Seasonal Energy Efficiency Ratio (SEER) rating. To obtain a SEER rating, the HVAC system is tested under prescribed conditions (i.e., certification conditions) to determine the efficiency at which it generates an energy output based on an energy input. The prescribed conditions generally involve very strict control over the zone conditions and the ambient conditions of the location of the installation of the HVAC system being tested. A higher SEER rating is indicative of a more energy efficient HVAC system. The higher SEER rating indicates that the HVAC system may be operated at a lower energy cost than an HVAC system having a lower SEER rating.

SUMMARY OF THE DISCLOSURE

In one embodiment, a method is provided that includes powering up a heating, ventilation, and air conditioning system and operating a sump heater for a compressor for a first predetermined period of time in response to the heating, ventilation, and air conditioning system being powered up.

In another embodiment, a heating, ventilation, and air conditioning system is provided that includes a compressor, a sump heater associated with the compressor, and a controller configured to control the compressor and the sump heater so that the sump heater is not operated while the compressor is operated.

The various characteristics described above, as well as other features, will be readily apparent to those skilled in the art upon reading the following detailed description of the embodiments of the disclosure, and by referring to the accompanying drawings.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
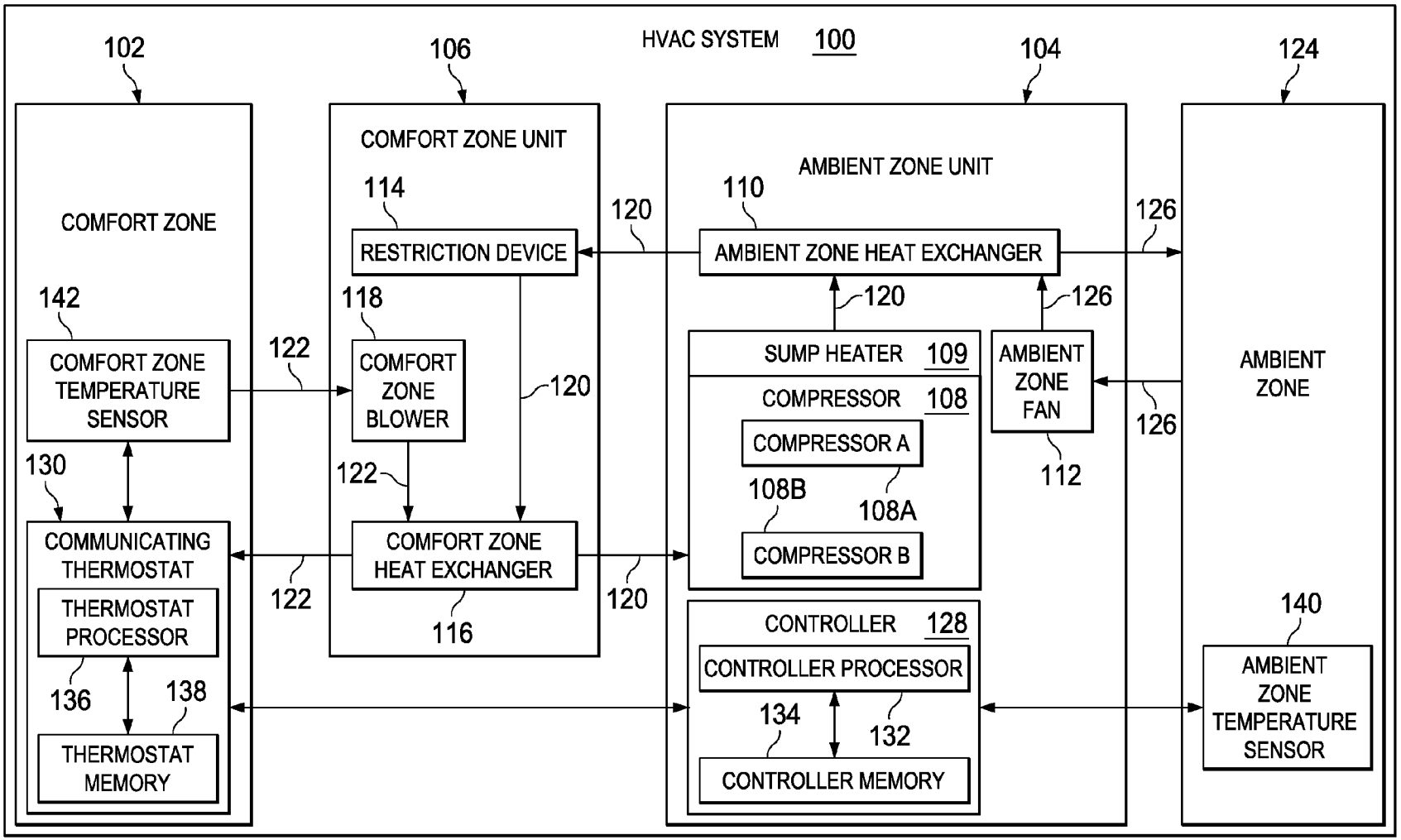
FIG. 1 is a simplified block diagram of an HVAC system according to embodiments of the disclosure.

FIG. 1 is a simplified schematic diagram of a heating/ventilation/air conditioning system 100 (hereinafter referred to as an "HVAC system 100") according to an embodiment. The HVAC system 100 operates to selectively control the temperature, humidity, and/or other air quality factors of a comfort zone 102. The HVAC system 100 generally comprises an ambient zone unit 104 and a comfort zone unit 106. The ambient zone unit 104 comprises a compressor 108, an ambient zone heat exchanger 110, and an ambient zone fan 112. The comfort zone unit 106 comprises a restriction device 114, a comfort zone heat exchanger 116, and a comfort zone blower 118. Refrigerant is carried between the compressor 108, the ambient zone heat exchanger 110, the restriction device 114, and the comfort zone exchanger 116 through refrigerant tubes 120.

The comfort zone blower 118 forces air from the comfort zone 102 into contact with the comfort zone heat exchanger 116, and subsequently back into the comfort zone 102 through air ducts 122. Similarly, the ambient zone fan 112 forces air from an ambient zone 124 into contact with the ambient zone heat exchanger 110 and subsequently back into the ambient zone 124 along an ambient air flow path 126. The HVAC system 100 is generally controlled by interactions between a controller 128 and a communicating thermostat 130. The controller 128 comprises a controller processor 132 and a controller memory 134 while the communicating thermostat 130 comprises a thermostat processor 136 and a thermostat memory 138.

Further, the controller 128 communicates with an ambient zone temperature sensor 140 while the communicating thermostat 130 communicates with a comfort zone temperature sensor 142. In this embodiment, communications between the controller 128 and the communicating thermostat 130, the controller 128 and the ambient zone temperature sensor 140, and the communicating thermostat 130 and the comfort zone temperature sensor 142 are capable of bidirectional communication. Further, communications between the controller processor 132 and the controller memory 134 and between the thermostat processor 136 and the thermostat memory 138 are capable of bidirectional communication. However, in alternative embodiments, the communication between some components may be unidirectional rather than bidirectional.

The HVAC system 100 is called a "split-system" because the compressor 108, the ambient zone heat exchanger 110, and the ambient zone fan 126 are colocated in the ambient zone unit 104 while the restriction device 114, comfort zone heat exchanger 116, and comfort zone blower 118 are colocated in the comfort zone unit 106 separate from the ambient zone unit 104. However, in alternative embodiments of an HVAC system, substantially all of the components of the ambient zone unit 104 and the comfort zone unit 106 may be colocated in a single housing in a system called a "package system." Further, in alternative embodiments, an HVAC system may comprise heat generators such as electrically resistive heating elements and/or gas furnace elements so that a comfort zone heat exchanger and the heat generators are both in a shared airflow path of a comfort zone blower.

While the comfort zone 102 may commonly be associated with a living space of a house or an area of a commercial building occupied by people, the comfort zone 102 may be also be associated with any other area in which it is desirable to control the temperature, humidity, and/or other air quality factors (i.e. computer equipment rooms, animal housings, and chemical storage facilities). Further, while the comfort zone unit 106 is shown as being located outside the comfort zone 102 (i.e. within an unoccupied attic or crawlspace), the comfort zone unit may alternatively be located within or partially within the comfort zone 102 (i.e. in an interior closet of a building).

Each of the ambient zone heat exchanger 110 and the comfort zone heat exchanger 116 may be constructed as air coils, shell and tube heat exchangers, plate heat exchangers, regenerative heat exchangers, adiabatic wheel heat exchangers, dynamic scraped surface heat exchangers, or any other suitable form of heat exchanger. The compressor 108 may be constructed as any suitable compressor, for example, a centrifugal compressor, a diagonal or mixed-flow compressor, an axial-flow compressor, a reciprocating compressor, a rotary screw compressor, a rotary vane compressor, a scroll compressor, or a diaphragm compressor. In this embodiment, the compressor 108 is capable of operating in multiple stages (e.g., stage A and stage B). More specifically, the compressor 108 comprises a compressor A 108*a* (for stage A) and a compressor B 108*b* (for stage B). Alternative embodiments of an HVAC system may comprise one or more compressors that are operable at more than one speed or at a range of speeds (i.e., a variable speed compressor).

Further, while the HVAC system 100 is shown as operated in a cooling mode to remove heat from the comfort zone 102, the HVAC system 100 is configured as a "heat pump" system that selectively allows flow of refrigerant in the direction shown in FIG. 1 to cool the comfort zone 102 or in the reverse direction to that shown in FIG. 1 to heat the comfort zone 102 in a heating mode. It will further be appreciated that in alternative embodiments, a second restriction device substantially similar to restriction device 114 may be incorporated into an ambient zone unit to assist with operation of an HVAC system in a heating mode substantially similar to the heating mode of HVAC system 100.

In the cooling mode, the compressor 108 operates to compress low pressure gas refrigerant into a hot and high pressure gas that is passed through the ambient zone heat exchanger 110. As the refrigerant is passed through the ambient zone heat exchanger 110, the ambient zone fan 112 operates to force air from the ambient zone 124 into contact with the ambient zone heat exchanger 110, thereby removing heat from the refrigerant and condensing the refrigerant into high pressure liquid form. The liquid refrigerant is then delivered to the restriction device 114. Forcing the refrigerant through the restriction device 114 causes the refrigerant to transform into a cold and low pressure gas. The cold gas is passed from the restriction device 114 into the comfort zone heat exchanger 116. While the cold gas is passed through the comfort zone heat exchanger 116, the comfort zone blower 118 operates to force air from the comfort zone 102 into contact with the comfort zone heat exchanger 116, heating the refrigerant and thereby providing a cooling and dehumidifying effect to the air, which is then returned comfort zone 102. In this embodiment, the HVAC system is using a vapor compression cycle, namely, the Rankine cycle. In the heating mode, generally, the direction of the flow of the refrigerant is reversed (compared to that shown in FIG. 1) so that heat is added to the comfort zone 102 using a reverse-vapor compression cycle, namely, the reverse-Rankine cycle. It will be appreciated that alternative embodiments of an HVAC system may use any other suitable thermodynamic cycle for transferring heat to and/or from a comfort zone.

Generally, the controller 128 communicates with the ambient zone temperature sensor 140 that is located in the ambient zone 124 (i.e. outdoors, outdoors within the ambient zone unit in an embodiment where the ambient zone unit is located in the ambient zone, adjacent the ambient zone unit in an embodiment where the ambient zone unit is located in the ambient zone, or any other suitable location for providing an ambient zone temperature or a temperature associated with the ambient zone). While the controller 128 is illustrated as positioned within the ambient zone unit 104, in alternative embodiments, the controller 128 may be positioned adjacent to but outside an ambient zone unit, outside a comfort zone, within a comfort zone unit, within a comfort zone, or at any other suitable location. It will be appreciated that in alternative embodiments, an HVAC system may comprise a second controller substantially similar to controller 128 and that the second controller may be incorporated into a comfort zone unit substantially similar to comfort zone unit 106. In the embodiment shown in FIG. 1, through the use of the controller processor 132 and the controller memory 134, the controller 128 is configured to process instructions and/or algorithms that generally direct the operation of the HVAC system 100.

The HVAC system 100 further comprises a sump heater 109 associated with the compressor 108. The sump heater 109 operates to heat an interior sump portion of the compressor 108 (in this embodiment, one or more sump heaters may be used to heat an interior sump portion of each compressor 108*a* and compressor 108*b* when sump heat is operated, in which case they would be denoted 109*a* for compressor 108*a*, and 109*b* for 108*b*). The sump heater 109 operates to vaporize liquid refrigerant when liquid refrigerant is present in the sump portion of the compressor 108. In this embodiment, the sump heater 109 is constructed of one or more electrically resistive heating elements. However, in alternative embodiments, the sump heater 109 may be constructed in any manner suitable for causing the vaporization of liquid refrigerant within the compressor 108.

The sump heater 109 of the HVAC system 100 can be controlled in many different ways by the controller 128 dependent upon the instructions and/or algorithms the controller 128 executes. In some cases, the HVAC system 100 may be controlled by controller 128 in a manner that operates or prevents operation of the sump heater 109 during a ratings certification test (such as a test for assigning a SEER value)

for the HVAC system 100. Since operating the sump heater 109 consumes energy, unnecessary operation of the sump heater 109 is directly correlated to a lower energy efficiency rating (such as a SEER rating). One example of undesired operation of the sump heater 109 is operating the sump heater 109 during operation of the compressor 108.

Accordingly, the present disclosure provides systems and methods of reducing unwanted operation of the sump heater 109 by enabling the controller 128 to control operation of the sump heater 109 in an efficient manner. Specifically, in some cases, the controller 128 prevents simultaneous operation of the sump heater 109 and the compressor 108. Further, in some cases, the controller 128 prevents operation of the sump heater 109 when the temperature of the ambient zone 124 is above a predetermined temperature. Still further, in some cases, the controller 128 selectively operates the sump heater 109 when the compressor 108 has not operated for a predetermined period of time and the ambient zone 124 temperature is below a predetermined temperature.

Each of the above described conditions of operating the sump heater 109 may potentially provide more efficient operation of the HVAC system as a whole, thereby possibly resulting in a higher energy efficiency rating. The systems and methods of achieving such increased energy efficiency ratings due to selective operation of the sump heater 109 are described in more detail below.

Figure 2:
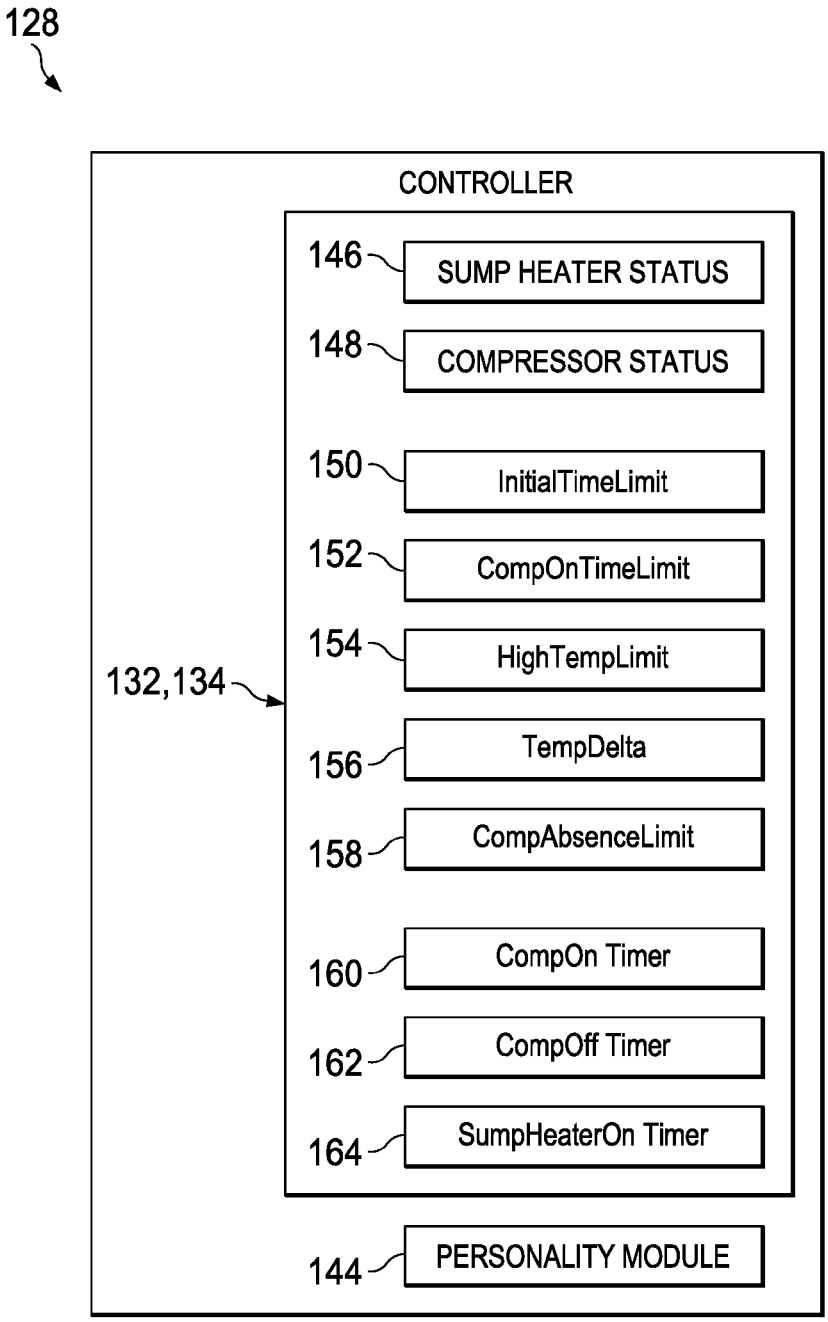
FIG. 2 is a simplified block diagram of a controller of the HVAC system of FIG. 1 according to embodiments of the disclosure.

Referring now to FIG. 2, the controller 128 is shown in greater detail. The controller 128 is used to control the different components of the HVAC system 100. The controller 128 further comprises a personality module 144 that stores information about the HVAC system 100 and the components thereof. The controller 128 retrieves information stored on the personality module 144 and gives instructions to the controller processor 132 and controller memory 134 based on the information provided by the personality module 144. The controller processor 132 and controller memory 134 comprise and/or operate to provide any necessary logical state indicators, keys, memories, timers, flags, counters, pollers, monitors, callers, and status indicators for processing and/or performing any programs, instructions, and/or algorithms provided to the controller 128.

The controller 128 comprises a plurality of algorithm status variables, specifically, a sump heater status 146 and a compressor status 148. The sump heater status 146 yields a positive result when the sump heater 109 is operating and yields a negative result when the sump heater 109 is not operating. In other words, the sump heater status 146 indicates whether the sump heater 109 is being operated to heat the sump portion of the compressor 108. If more than one heater is used and controlled independently, then more than one status will be needed (i.e. sump heater status 146*a* would correspond to sump heater 109*a* operation, 146*b* to 109*b*, and so forth). The compressor status 148 yields a positive result when the compressor 108 (in this case, either compressor 108*a* or compressor 108*b*) is being operated and yields a negative result when the compressor 108 is not operating (in this case, neither the compressor 108*a* nor the compressor 108*b*). For independent sump heat control, then likewise more than one compressor status will be needed.

The controller 128 further comprises a plurality of stored variables, specifically, an InitialTimeLimit 150, a CompOnTimeLimit 152, a HighTempLimit 154, a TempDelta 156, and a CompAbsenceLimit 158. The variables InitialTimeLimit 150, CompOnTimeLimit 152, and CompAbsenceLimit 158 each store a time value while the variables HighTempLimit 154 and TempDelta 156 each store temperature values. The temperature variables are configurable to represent and/or store temperatures in degrees Fahrenheit (° F.), degrees Celsius (° C.), Kelvin (K), or degrees Rankine (° R), however this embodiment uses degrees Fahrenheit.

In this embodiment, InitialTimeLimit 150 stores a value of 10 hours. However, in alternative embodiments an InitialTimeLimit may store any other suitable time value within a range of about 5 hours to about 20 hours.

Further in this embodiment, CompOnTimeLimit 152 stores a value of 4 minutes. However, in alternative embodiments a CompOnTimeLimit may store any other suitable time value within a range of about 1 minute to about 10 minutes.

Still further, CompAbsenceLimit 158 stores a value of 30 minutes. However, in alternative embodiments a CompAbsenceLimit may store any other suitable time value within a range of about 25 minutes to about 120 minutes.

In this embodiment, HighTempLimit 154 stores a value of 85° F. However, in alternative embodiments, a HighTempLimit may store any other suitable temperature value within a range of about 70° F. to about 90° F.

Similarly, TempDelta 156 stores a value of 10° F. However, in alternative embodiments, a TempDelta may store any other suitable temperature value within a range of about 5° F. to about 20° F.

Still referring to FIG. 2, the controller 128 further comprises a plurality of timers, specifically, a CompOn Timer 160, a CompOff Timer 162, and a SumpHeaterOn Timer 164. The CompOn Timer 160 is a timer configured to selectively store and report a cumulative length of time compressor 108 has run since the CompOn Timer 160 was last reset to zero. The CompOff Timer 162 is a timer configured to selectively store and report a cumulative length of time compressor 108 has been inactive (not operated) since the CompOff Timer 162 was last reset to zero. The SumpHeaterOn Timer 164 is a timer configured to selectively store and report a cumulative length of time sump heater 109 has run since the SumpHeaterOn Timer 164 was last reset to zero.

In this embodiment, the values for the InitialTimeLimit 150, the CompOnTimeLimit 152, the HighTempLimit 154, the TempDelta 156, and the CompAbsenceLimit 158 are provided to the controller 128 from the personality module 144. In alternative embodiments of an HVAC system, the values for a InitialTimeLimit, a CompOnTimeLimit, a HighTempLimit, a TempDelta, and/or a CompAbsenceLimit may be selected by a user, hard coded into a controller, or provided in any other suitable manner.

Figure 3:
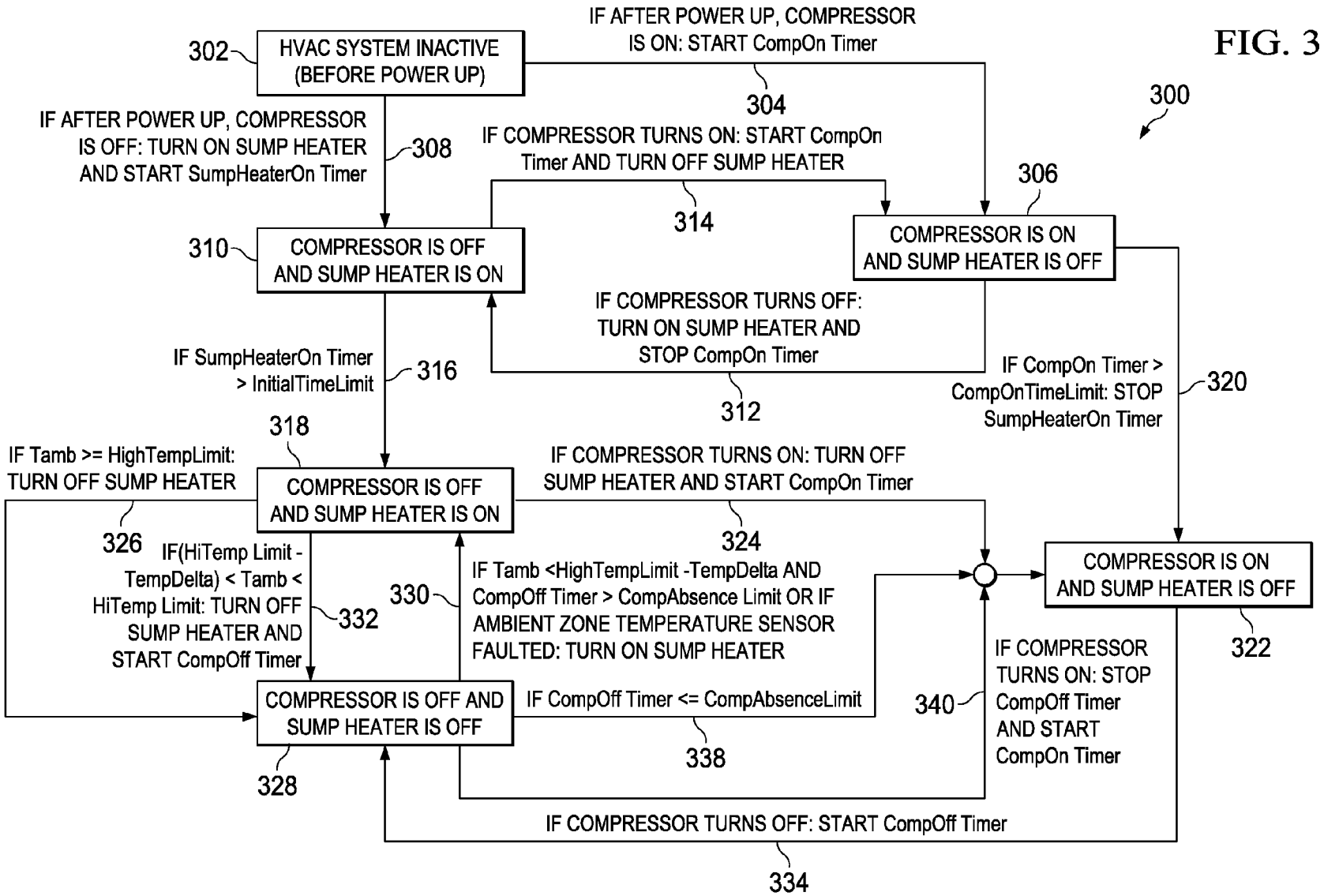
FIG. 3 is a schematic flow chart that illustrates a method of operating the HVAC system of FIG. 1 according to the disclosure.

Referring now to FIG. 3, a flow chart of a method 300 of operating an HVAC system such as HVAC system 100 is shown. The method 300 is hereinafter described by detailing a plurality of states of operation and explaining what conditions are met to allow and/or cause transition from one state to another.

When the HVAC system 100 has not yet been powered up or where power to the HVAC system 100 is being cycled and is powered down, the HVAC system 100 is inactive as represented by state 302. When power is applied to the HVAC system 100, the controller 128 polls the compressor status 148 to determine whether the compressor 108 is on or off and method 300 exits state 302 to proceed with either path condition 304 or condition 308, respectively. At condition 304, if the compressor 108 is on at power up, the method 300 starts the CompOn Timer 160 and the HVAC system 100 is then operating in state 306 where the compressor 108 is on but the sump heater 109 is off.

However, if the controller 128 determines that the compressor 108 is off after initialization of HVAC system 100, thereby meeting the condition 308, the method 300 turns on the sump heater 109 and starts the SumpHeaterOn Timer 164, leaving the HVAC system 100 operating in state 310 where the compressor 108 is off and the sump heater 109 is on.

If the HVAC system 100 is operating in state 306 and the compressor 108 turns off, the method 300 will exit state 306 to proceed with either path condition 312 or condition 320 according to the CompOn Timer 160. At condition 312, the method 300 turns on the sump heater and stops the CompOn Timer 160, leaving the HVAC system 100 operating in state 310.

While operating in state 310, if the compressor 108 turns on, the method 300 will exit state 310 to proceed with either path condition 314 or condition 316. If the compressor 108 is on, at condition 314, the method 300 starts the CompOn Timer 160 and turns off the sump heater 109, leaving the HVAC system 100 operating in state 306 as previously described.

However, if while operating in state 310, the method 300 determines at condition 316 that the value of the SumpHeaterOn Timer 164 is greater than the InitialTimeLimit 150, the HVAC system 100 is then operating at state 318 where the compressor 108 is off and the sump heater 109 is on.

However, if the HVAC system 100 were operating in state 306 and the method 300 determined at condition 320 that the value of the CompOn Timer 160 was greater than the value of the CompOnTimeLimit 152, the method 300 stops the SumpHeaterOn Timer 164, leaving the HVAC system 100 operating in the state 322 where the compressor 108 is on and the sump heater 109 is off.

If the HVAC system 100 is operating in state 318 the method 300 will exit state 318 to proceed with either path condition 324, condition 326, or condition 332. If the compressor 108 turns on, this is condition 324, and the method 300 turns off the sump heater 109 and starts the CompOn Timer 160, leaving the HVAC system 100 operating in state 322.

If, however, the HVAC system 100 is operating in state 318 and the method 300 determines at condition 326 that the temperature of the ambient zone 124 (as reported by the ambient zone temperature sensor 140) is greater than or equal to the HighTempLimit 154T the method 300 turns off the sump heater 109, leaving the HVAC system 100 operating in state 328 where the compressor 108 is off and the sump heater 109 is also off. However if the temperature of the ambient zone 124 is between HiTemp Limit 154 minus TempDelta 156 and the HiTemp Limit 154, the path is condition 332 and method 300 will turn off the sump heater 109 and start CompOff Timer 162 before leaving the HVAC system 100 in state 328.

While the HVAC system 100 is operating in state 328 the method 300 will exit state 328 to proceed with either path condition 330, condition 338, or condition 340. If at condition 330 the ambient zone 124 temperature is determined to be less than HighTempLimit 154 minus TempDelta 156 and the CompOff Timer 162 is greater than the CompAbsence Limit 158, the method 300 turns on the sump heater 109, leaving the HVAC system 100 operating in state 318. Similarly, while the HVAC system 100 is operating in state 328, if at condition 330 the ambient zone temperature sensor 140 is determined to be faulted (nonoperational), the method 300 turns on the sump heater 109, leaving the HVAC system 100 operating in state 318.

While the HVAC system 100 is operating at state 328, if at condition 338 the method 300 determines that the CompOff Timer 162 is less than or equal to the CompAbsenceLimit 158, the HVAC system 100 continues to operates at state 328.

However, if while the HVAC system 100 is operating in state 328 and at condition 340 the compressor 108 turns on, the method 300 starts the CompOn Timer 160 and stops the CompOff Timer 162, leaving the HVAC system 100 operating in state 322.

With the HVAC system 100 operating at state 322 the method 300 will exit state 322 only to proceed with condition 334. If the compressor 108 turns off at condition 334, the method 300 starts the CompOffTimer 162, leaving the HVAC system 100 operating in state 328 where the compressor 108 is off and the sump heater 109 is off.

It is according to the above-described conditions of method 300 that the method 300 controls the operation of HVAC system 100 in the various above-described states of method 300.

Figure 4:
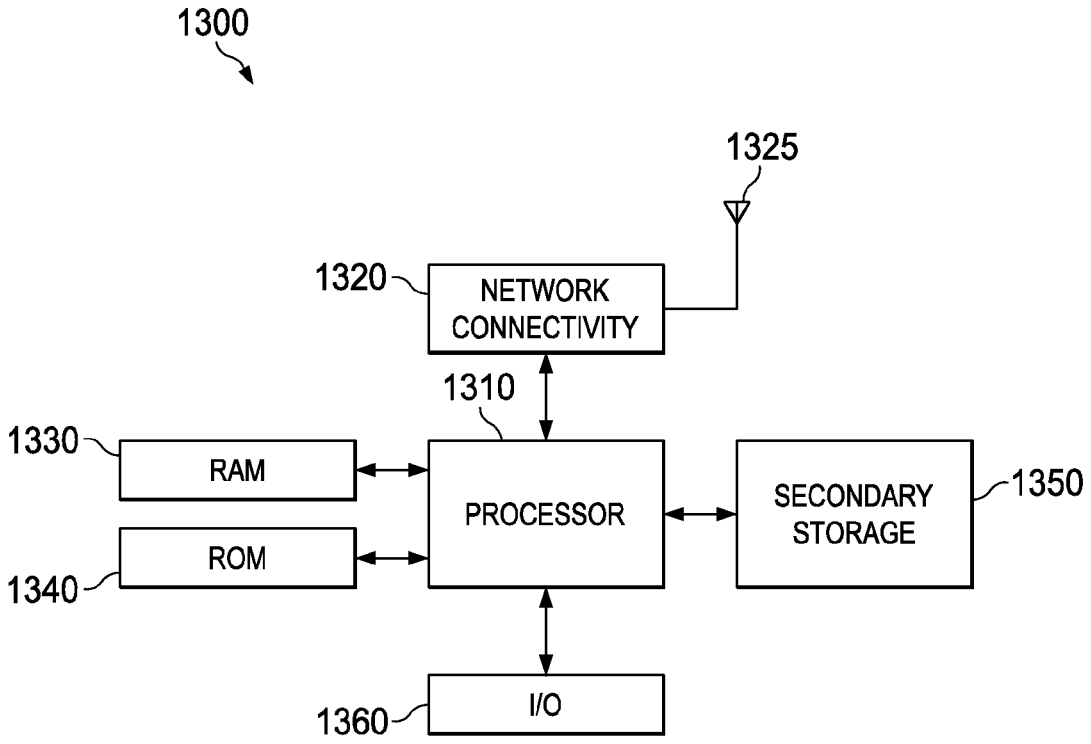
FIG. 4 illustrates a general-purpose processor (e.g., electronic controller or computer) system suitable for implementing the several embodiments of the present disclosure.

Referring now to FIG. 4, the HVAC system 100 described above comprises a processing component (such as processors 132 or 136 shown in FIG. 1) that is capable of executing instructions related to the actions described previously. The processing component may be a component of a computer system. FIG. 4 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor component or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive such as the personality module 144 shown in FIG. 2). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components depicted in the previously described FIG. 1, such as the temperature sensors 142 and 140.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of controlling a heating, ventilation, and air conditioning (HVAC) system, comprising:

powering up the HVAC system;

without respect to an ambient temperature, at least one of (1) operating a sump heater for a compressor for a first predetermined cumulative period of time in response to the HVAC system being powered up and (2) operating the compressor for a second predetermined cumulative period of time in response to the HVAC system being powered up; and in response to achieving at least one of the first predetermined cumulative period of time of operation of the sump heater and the second predetermined cumulative period of time of operation of the compressor, selectively operating the sump heater as a function of the ambient temperature after the compressor has been off for a third predetermined period of time.

2. The method according to claim 1, wherein if the ambient temperature is above a first predetermined temperature, operation of the sump heater is discontinued.

3. The method according to claim 2, wherein the first predetermined temperature is within a range of about 70° F. to about 90° F.

4. The method according to claim 1, wherein the first predetermined period of time is within a range of about 5 hours to about 20 hours.

5. The method according to claim 1, wherein if the compressor turns on before the first predetermined period of time has elapsed, the operation of the sump heater is discontinued.

6. The method according to claim 1, wherein the sump heater is not operated while the compressor is operated.

7. The method according to claim 1, wherein if the compressor turns on before the first predetermined period of time has elapsed and the compressor has not operated for a second predetermined period of time, subsequent stopping operation of the compressor causes the sump heater to resume operation.

8. The method according to claim 7, wherein the second predetermined period of time is within a range of about 1 minute to about 10 minutes.

9. The method according to claim 1, wherein if the compressor turns on before the first predetermined period of time has elapsed and the compressor has operated for a second predetermined period of time, the HVAC system operates with the compressor off and the sump heater off.

10. The method according to claim 9, wherein if operation of the compressor is discontinued for the third predetermined period of time and if the ambient temperature is less than a first predetermined temperature, the sump heater is turned on.

11. The method according to claim 10, wherein the first predetermined temperature is defined by a second predetermined temperature minus a predetermined number of degrees.

12. The method according to claim 11, wherein the predetermined number of degrees is within a range of about 5° F. to about 20° F.

13. The method according to claim 10, wherein the third predetermined period of time is within a range of about 25 minutes to about 120 minutes.

14. A heating, ventilation, and air conditioning (HVAC) system, comprising:

a compressor;

a sump heater associated with the compressor; and a controller configured to control the compressor and the sump heater so that (1) the sump heater is not operated while the compressor is operated and (2) after at least one of the compressor and the sump heater are operated for a first predetermined cumulative period of time and a second predetermined cumulative period of time, respectively, the sump heater is prevented from operating for a third predetermined period of time after a stoppage of the compressor.

15. The HVAC system according to claim 14, wherein the controller is configured to operate the sump heater for the first predetermined cumulative period of time in response to the HVAC system being powered up.

16. The HVAC system according to claim 14, wherein the first predetermined period of time is within a range of about 5 hours to about 20 hours.

17. The HVAC system according to claim 14, wherein the controller is configured to control operation of the sump heater in response to an ambient zone temperature.

18. The HVAC according to claim 17, wherein the controller is configured to turn off the sump heater while the ambient zone temperature is greater than a first predetermined temperature.

19. The HVAC system according to claim 18, wherein the first predetermined temperature is within a range of about 70° F. to about 90° F.

20. The HVAC system according to claim 17, wherein the controller is configured to keep the sump heater off until the ambient zone temperature is less than a second predetermined temperature.

21. The HVAC system according to claim 20, wherein the second predetermined temperature is within a range of about 70° F. to about 90° F. minus a delta in the range of about 5° F. to about 20° F.

22. The HVAC system according to claim 14, wherein the third predetermined time period is within a range of about 25 to about 120 minutes.

23. The HVAC according to claim 17, wherein the controller is configured to turn on the sump heater while the ambient zone temperature sensor is absent, faulted or otherwise not working and the compressor is not operating.

* * * * *

UNITED STATES PATENT AND TRADEMARK OFFICE

CERTIFICATE OF CORRECTION

PATENT NO. : 8,116,911 B2
APPLICATION NO. : 12/272504
DATED : February 14, 2012
INVENTOR(S) : John J. Bailey et al.

It is certified that error appears in the above-identified patent and that said Letters Patent is hereby corrected as shown below:

On the Title Page, Item (75) Inventors: - "Kristen L. Schaefer" should read "Kristin L. Schaefer"

Signed and Sealed this
Sixteenth Day of December, 2014

Michelle K. Lee

Michelle K. Lee
*Deputy Director of the United States Patent and Trademark Office*